US006852654B2

(12) United States Patent
Fuller et al.

(10) Patent No.: US 6,852,654 B2
(45) Date of Patent: Feb. 8, 2005

(54) DIFFERENTIALLY ENTANGLED NONWOVEN FABRIC

(75) Inventors: Charles R. Fuller, Kannapolis, NC (US); Sheridan D. Ledbetter, Maumelle, AR (US)

(73) Assignee: Polymer Group, Inc., North Charleston, SC (US)

( * ) Notice: Subject to any disclaimer, the term of this patent is extended or adjusted under 35 U.S.C. 154(b) by 0 days.

(21) Appl. No.: 09/976,537

(22) Filed: Oct. 12, 2001

(65) Prior Publication Data

US 2002/0146957 A1 Oct. 10, 2002

Related U.S. Application Data

(60) Provisional application No. 60/239,753, filed on Oct. 12, 2000.

(51) Int. Cl.[7] ..... D04H 1/46; B32B 7/02

(52) U.S. Cl. ..... 442/408; 442/110; 442/123; 442/361; 442/408; 442/415; 442/416; 428/218

(58) Field of Search ..... 442/361, 408, 442/415, 416, 123, 110; 428/218

(56) References Cited

U.S. PATENT DOCUMENTS

| | | | | | |
|---|---|---|---|---|---|
| 2,862,251 | A | | 12/1958 | Kalwaites | |
| 3,025,585 | A | | 3/1962 | Griswold | |
| 3,033,721 | A | | 5/1962 | Kalwaites | |
| 3,081,515 | A | | 3/1963 | Griswold et al. | |
| 3,193,436 | A | | 7/1965 | Kalwaites | |
| 3,485,706 | A | | 12/1969 | Evans | |
| 3,769,659 | A | | 11/1973 | Kalwates | |
| 4,377,615 | A | * | 3/1983 | Suzuki et al. | 428/213 |
| 4,426,417 | A | | 1/1984 | Meitner et al. | |
| 4,475,903 | A | | 10/1984 | Collins | |
| 4,569,883 | A | * | 2/1986 | Renjilian | 442/194 |
| 4,647,490 | A | | 3/1987 | Bailey et al. | |
| 5,098,764 | A | | 3/1992 | Drelich et al. | |
| 5,801,107 | A | * | 9/1998 | Everhart et al. | 442/408 |
| 5,849,647 | A | | 12/1998 | Neveu | |
| 6,200,669 | B1 | * | 3/2001 | Marmon et al. | 428/198 |

* cited by examiner

*Primary Examiner*—Ula Ruddock
(74) *Attorney, Agent, or Firm*—Wood, Phillips, Katz, Clark & Mortimer

(57) ABSTRACT

The invention is directed to a hydroentangled nonwoven fabric, the outer surface of which exhibits highly entangled fibers whereas the inner layer exhibits lightly entangled fibers. In particular, the present invention contemplates that a fabric is formed from a fibrous batt that is subjected to fluidic energy, preferably hydraulic energy, applied to one or both faces of a fibrous batt. The hydraulic energy is moderated against the basis weight of the fibrous batt to achieve the degree of surface entanglement desired. Fabrics formed in accordance with the present invention exhibit a sufficient degree of softness and non-linting performance, while providing the necessary resistance to tearing and abrasion, to facilitate use in a wide variety of applications such as cast padding or orthopedic wraps.

5 Claims, 4 Drawing Sheets

DIFFERENTIALLY ENTANGLED NONWOVEN FABRIC

CROSS-REFERENCE TO RELATED APPLICATION

This application claims the priority of Provisional Application No. 60/239,753, which was filed on Oct. 12, 2000, and the disclosure of which is incorporated herein by reference.

TECHNICAL FIELD

The invention disclosed herein is directed to a hydroentangled nonwoven fabric and the making thereof, whereby the outer surface fibers of a single fibrous batt are highly hydroentangled and the inner fibers of the single fibrous batt are lightly entangled, the resulting fabric thus exhibits a low linting, lofty structure, and favorable tactile and ductile softness while obtaining sufficient physical strength.

BACKGROUND OF THE INVENTION

The use of natural fiber materials in medical and industrial applications has been found to be highly advantageous in situations where a non-linting, absorbent pad or wiper is required. A material that has been employed in such applications is found in the Webril material from the Kendall Company of Massachusetts. The Webril material is a compressed, mercerized cotton fibrous batt. The mercerization process involves the swelling of the natural cotton's ribbon like profile into an approximately round profile of larger diameter. Typically, caustic washes are utilized while the cotton batt is under tension to induce the swelling of the cotton fiber. Because of the use of a caustic solution, it is necessary to subsequently treat the cotton material with an acidic solution so as to neutralize the material and render it useable. A number of complicated steps are required to successfully perform the process, with a significant amount of environmentally harmful effluent being produced.

In the interest of forming natural fiber nonwoven pads or wipers without the by-products of mercerization, the application of a resin binder in conjunction with hydroentanglement was explored as evidenced by U.S. Pat. Nos. 2,862,251, 3,033,721, 3,769,659, and 3,931,436 to Kalwaites et al., and U.S. Pat. Nos. 3,081,515 and 3,025,585 to Griswold et al, the disclosures of which are herein incorporated by reference. The application of resin binder was found to have a deleterious effect on the softness of the corresponding nonwoven fabric.

The findings by Evans, U.S. Pat. No. 3,485,706, the disclosure of which is herein incorporated by reference, suggested that the impedance of energetic water streams on a fibrous batt could produce a nonwoven fabric by the entanglement of those fibers with one another through the depth of the fibrous batt, thus obviating the need for a resin binder. However, the action of the water streams upon the fibrous batt and the action of entangling the fibers result in a fabric having significantly decreased bulk, and correspondingly decreased tactile and ductile softness.

Various attempts have been made in order to obtain a durable natural fiber nonwoven fabric while maintaining sufficient strength and softness. In U.S. Pat. No. 5,849,647 to Neveu, herein incorporated by reference, a hydrophilic cotton stratified structure is formed by interceding an air-randomized core in between two previously formed, highly fiber oriented carded layers. The stratified layers are subsequently treated with a soda liquor which is then boiled off to render an integrated structure. While a cotton structure performed by the manner described can render an ultimate material that is low linting, the material must undergo substantial processing in the forming of separate and distinct layers and the juxtaposition of those layers during the caustic integration step. U.S. Pat. No. 4,647,490 to Bailey et al., the disclosure of which is herein incorporated by reference, formed an apertured, cotton fiber nonwoven material by hydroentanglement induced by oscillating water streams. In the Bailey process, the fibers of the fibrous batt are washed down and through the fibrous batt in order to entangle the fibers and form apertures in the fabric. U.S. Pat. No. 4,426,417 to Meitner et al., the disclosure of which is herein incorporated by reference, incorporated the use of thermoplastic meltblown during the formation of a fibrous batt as a means for attaining the loft for absorbency and maintain sufficient physical strength by bonding the fibers together. As the nature of the Meitner process is based upon the total and effective binding of the fibers to the thermoplastic meltblown there are potential issues with unbound or loosely bound fibers being disengaged from the meltblown.

Given the prior art attempt to form a non-linting, soft and yet strong absorbent materials, there remains a need for a nonwoven fabric exhibiting these characteristics and yet is formed in an expeditious and uncomplicated manner.

A method for forming a suitable nonwoven fabric meeting the aforementioned requirements has been identified in the application of fluidic energy such that a single fibrous batt is imparted with a highly entangled surface of outer fibers while retaining the loft and absorbency of a lightly entangled central layer of core fibers.

SUMMARY OF THE INVENTION

The present invention is directed to a method of forming a nonwoven fabric, the outer surface of which exhibits highly entangled fibers whereas the inner layer exhibits lightly entangled fibers. In particular, the present invention contemplates that a fabric is formed from a fibrous batt that is subjected to fluidic energy, preferably hydraulic energy, applied to one or both faces of a fibrous batt. The hydraulic energy is moderated against the basis weight of the fibrous batt to achieve the degree of surface entanglement desired.

In accordance with the present invention, a method of making a nonwoven fabric embodying the present invention includes the steps of providing a fibrous batt comprising a fibrous matrix. While use of natural fibers is common, the fibrous matrix may comprise synthetic fibers or blends of natural and synthetic fibers. The synthetic fibers are chosen from the group consisting of polyacrylates, polyolefins, polyamides, and polyesters and combinations thereof. Further, the synthetic fibers may comprise homogeneous, bicomponent, and/or multi-component profiles and the blends thereof.

In a particularly preferred form, the fibrous batt is carded and cross-lapped to form a fibrous batt. The fibrous batt is then continuously indexed through a station composed of a rotary foraminous surface and a fluidic manifold. Fluid streams from the fluidic manifold impinge upon the fibrous batt at a controlled energy level so as to integrate a portion of the overall fibrous content. The energy level is controlled such that the energy is sufficient to induce high levels of entanglement in the surface fibers, but has insufficient transmitted energy to induce high levels of entanglement of the inner fibers. A plurality of such stations can be employed whereby fluid streams are at the same or differing energy levels, impinging one or alternately both surfaces of the fibrous batt. The resulting differentially entangled nonwoven web exhibits a highly entangled fibrous outer surface and a lightly entangled fibrous core.

Subsequent to hydroentanglement, the present method further contemplates the provision of a three-dimensional image transfer device having a movable imaging surface. Such three-dimensional image transfer devices are disclosed in U.S. Pat. No. 5,098,764, the disclosure of which is hereby incorporated by reference. In a typical configuration, the image transfer device may comprise a drum-like apparatus that is rotatable with respect to one or more hydroentangling manifolds.

It is within the purview of this invention that tension control means can be employed to further enhance the physical performance of the resulting lofty material.

A further aspect of the present invention is directed to a method of forming a nonwoven fabric which exhibits a sufficient degree of softness and non-linting performance, while providing the necessary resistance to tearing and abrasion, to facilitate use in a wide variety of applications. The fabric exhibits a high degree of loft and absorbency, thus permitting its use in those applications in which the fabric is applied as a cleaning wipe. Further, the material exhibits pleasant aesthetics, thus lending itself to application in medical applications.

A method of making the present durable nonwoven fabric comprises the steps of providing a fibrous matrix or batt, which is subjected to controlled levels of hydraulic energy. A homogeneous cotton fibrous batt has been found to desirably yield a fabric with soft hand and good absorbency. The fibrous batt is formed into a differentially entangled nonwoven fabric by the application of sufficient energy to entangle only the outer layers of the fibrous batt. Subsequently, the fabric can be passed over an image transfer device defined by three-dimensional elements against which the differentially entangled nonwoven fabric is forced during further application of further energy, whereby the fibrous constituents of the web are imaged and patterned by movement into regions between the three-dimensional elements of the transfer device.

It is within the purview of the present invention that physical property altering chemistries can be incorporated into the resulting differentially entangled fabric. Such chemistries include for example antimicrobial and anti-static agents which can be durably applied to the constituent fibers of the fibrous batt, to the fibrous batt during manufacture, and/or to the resulting fabric.

Other features and advantages of the present invention will become readily apparent from the following detailed description, the accompanying drawings, and the appended claims.

DETAILED DESCRIPTION

Figure 1:
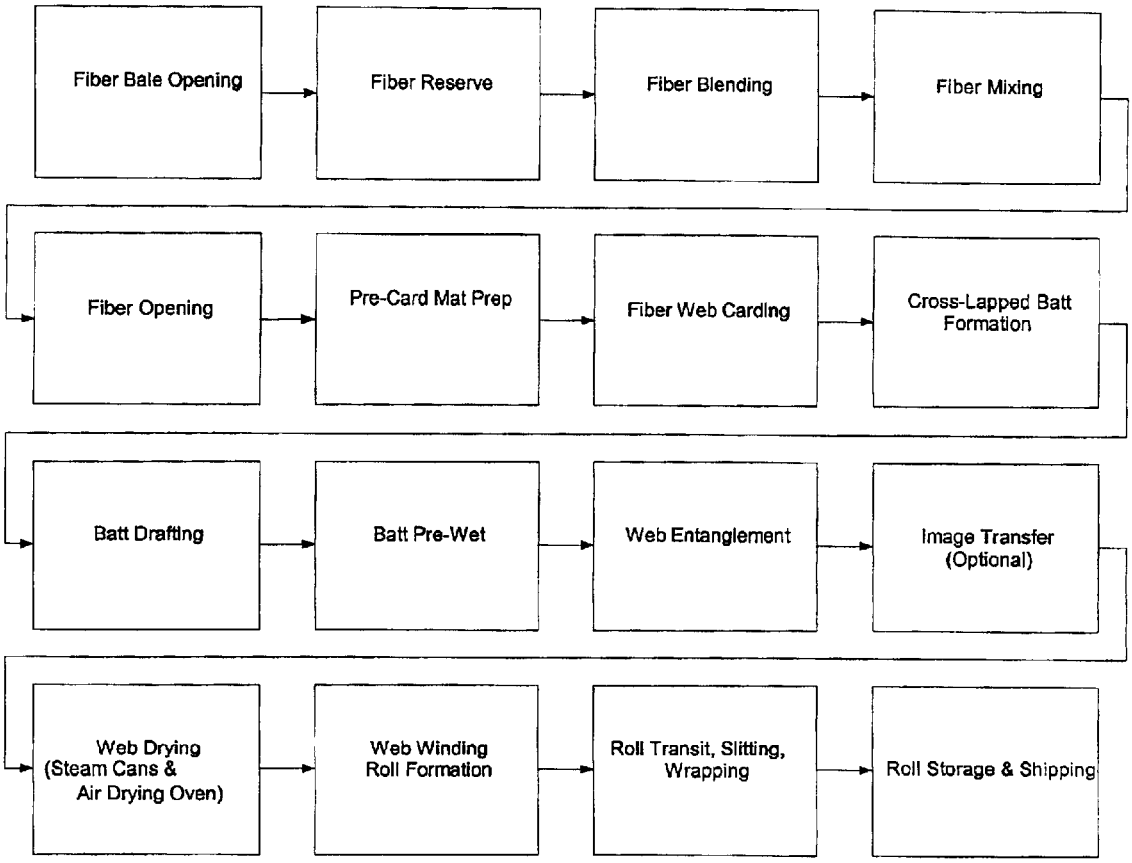
FIG. 1 is a diagrammatic view of an apparatus for manufacturing a differentially entangled nonwoven fabric, embodying the principles of the present invention.

While the present invention is susceptible of embodiment in various forms, there is shown in the drawings and will hereinafter be described a presently preferred embodiment of the invention, with the understanding that the present disclosure is to be considered as an exemplification of the invention, and is not intended to limit the invention to the specific embodiment illustrated.

The present invention is directed to a method of forming nonwoven fabrics by hydroentanglement, wherein the outer surface of the fabric is substantially more entangled than the core layer. Hydroentanglement by this method is controlled by the application of fluidic energy such that the energy imparted into fibers of the fabric is sufficient to highly entangle only the outer fibers. The inner fibers are lightly entangled such that the overall structure is resistant to separation of the layers, yet retain much of the loftiness or bulk of the fibrous core layer that is responsible for tactile and ductile softness as well as absorbency. By advancing the fibrous batt with a relatively low tension through one or more entanglement stations, differential fiber entanglement is achieved, with the physical properties, both aesthetic and mechanical, of the resultant fabric being desirably achieved.

In accordance with a further aspect of the present invention, a nonwoven fabric can be produced which can be employed in medical applications such as undercast padding, with the fabric exhibiting sufficient strength, softness, drapeability, extensibility, and cushioning qualities. The level of entanglement of the nonwoven fabrics for this application may be controlled such that the level of entanglement of the surfaces is reduced so that the fibrous inner layer can retain further loft. In the alternative, the surface entanglement can be increased while retaining a somewhat reduced loftiness of the fibrous inner layer so that the surface layers are extremely resistant to linting. A material of this nature is found to have use in the graphic arts and lithography as it can be employed as a non-abrasive, absorbent wiper. It is within the scope of the present invention to control the level of entanglement in the resulting fabric to obtain materials with varying degrees of loft and linting performance.

Nonwoven fabrics are frequently produced using staple length fibers, the fabric typically has a degree of exposed surface fibers that will lint if not sufficiently retained into the structure of the fabric. The present invention provides a finished fabric that can be cut, processed or treated, and packaged for retail sale. The cost associated with forming and finishing steps can be desirably reduced.

Figure 2:
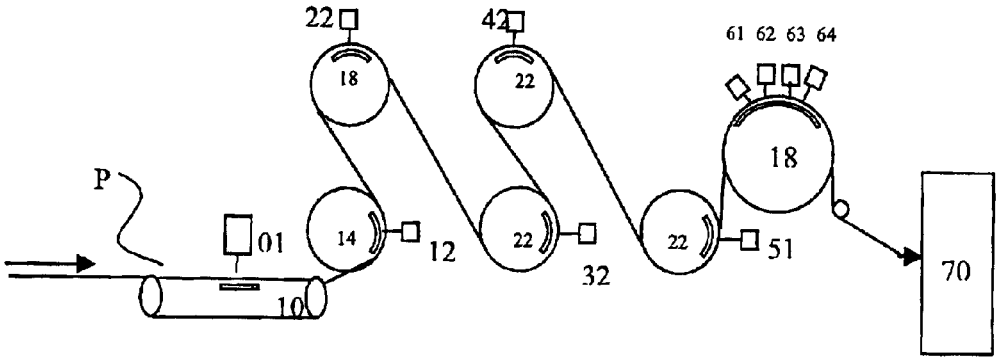
FIG. 2 is a diagrammatic view of five consecutive entangling sections and an image transfer station.

With reference to FIG. 2, therein is illustrated an apparatus for practicing the present method for forming a nonwoven fabric. The fabric is formed from a fibrous batt that typically comprises natural fibers, but may comprise synthetic staple fibers and natural/synthetic fiber blends. The fibrous batt is preferably carded and cross-lapped to form a fibrous batt, designated P. In a current embodiment, the fibrous batt comprises 100% cross-lap fibers, that is, all of the fibers of the web have been formed by cross-lapping a carded web so that the fibers are oriented at an angle relative to the machine direction of the resultant web. In this current embodiment, the fibrous batt has a draft ratio of approximately 2.5 to 1. U.S. Pat. No. 5,475,903, the disclosure of which is hereby incorporated by reference, illustrates a web drafting apparatus.

FIG. 2 illustrates a hydroentangling apparatus for forming nonwoven fabrics in accordance with the present invention. The apparatus includes a foraminous forming surface in the form of belt 02 upon which the fibrous batt P is positioned for pre-entangling by entangling manifold 01 into a wetted, lightly entangled fibrous web P'. Pre-entangling of the fibrous web is subsequently effected by movement of the web P' sequentially over a drum 10 having a foraminous forming surface, with entangling manifold 12 effecting entanglement of the web. Further entanglement of the web may be effected on the foraminous forming surface of a drum 20 by entanglement manifold 22, with the web subsequently passed over successive foraminous drums 30, 40 and 50, for successive entangling treatment by entangling manifolds 32, 42 and 51. The total, optimal energy input to the fibrous batt to give the desired level of surface entanglement is in the range of about 0.027 to 0.046 hp-hr/lb.

The entangling apparatus of FIG. 2 may further include an imaging and patterning drum 18 comprising a three-dimensional image transfer device for effecting imaging and patterning of the now-entangled precursor web. The image transfer device includes a moveable imaging surface which moves relative to a plurality of entangling manifolds 61, 62, 63 and 64, which act in cooperation with three-dimensional elements defined by the imaging surface of the image transfer device to effect imaging and patterning of the fabric being formed. The total energy applied to the fibrous batt of the imaging manifolds is adjusted to maintain the energy input in the range of about 0.027 to 0.046 hp-hr/lb.

The present invention contemplates that the fibrous web P' be advanced onto the moveable imaging surface of the image transfer device at a rate which is substantially equal to the rate of movement of the imaging surface. A J-box or scray can be employed for supporting the precursor web P' as it is advanced onto the image transfer device to thereby minimize tension within the fibrous web. By controlling the rate of advancement of the fibrous batt P and the web P' through the process so as to minimize, or substantially eliminate, tension within the web, differential hydroentanglement of the fibrous web is desirably effected.

Figure 3:
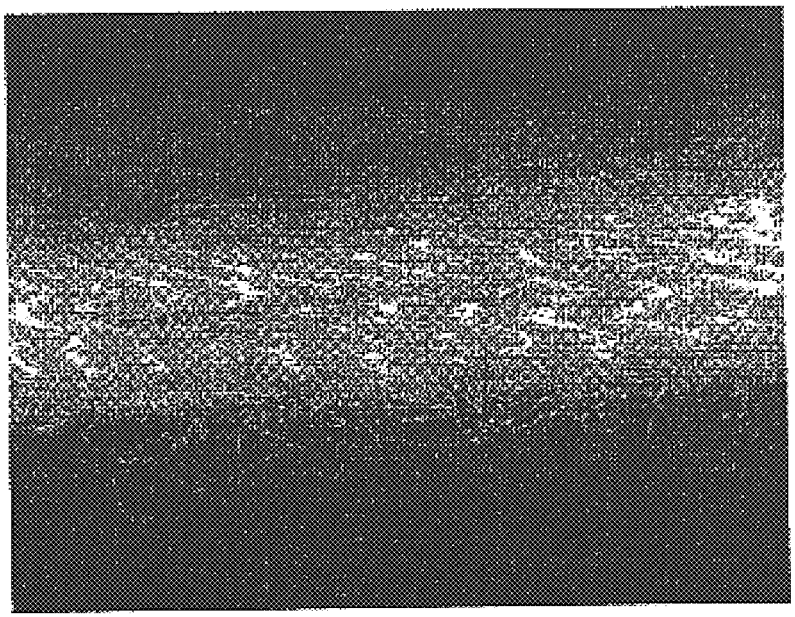
FIG. 3 is a cross-sectional view of a differentially entangled nonwoven fabric of the present invention, magnified at 20×.
Figure 4:
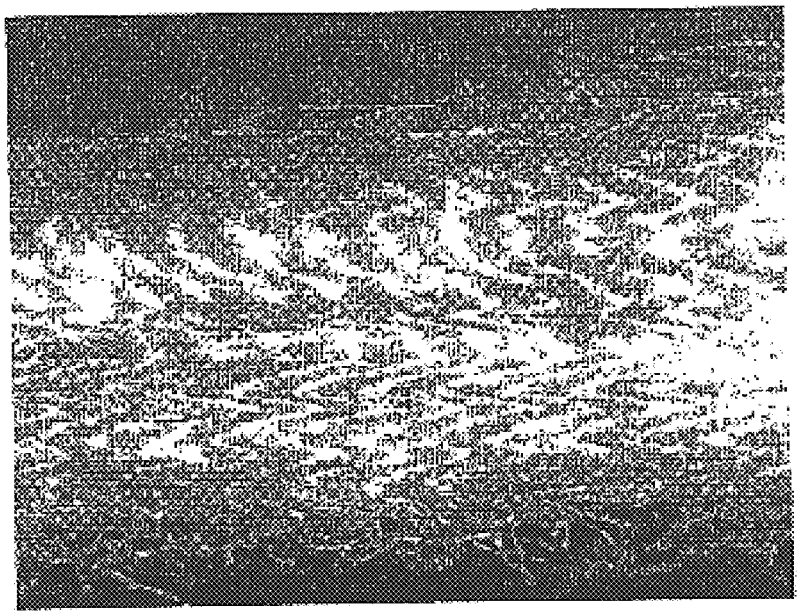
FIG. 4 is a cross-sectional view of the differentially entangled nonwoven fabric shown in FIG. 2, magnified at 40×.

FIG. 3 and FIG. 4 show a cross-section of a material produced by the present invention at 20× and 40× magnification, respectively. It should be noted that the "upper" and "lower" layers correspond to the highly entangled outer fibers of the fibrous batt.

Figure 5:
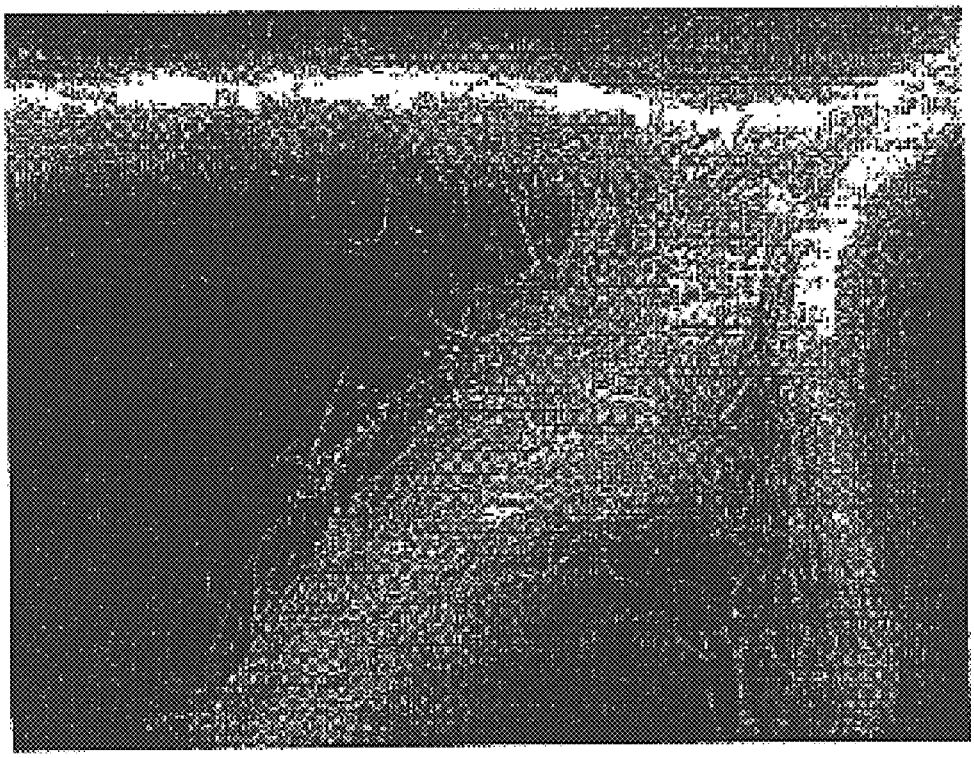
FIG. 5 is a cross-sectional view of the differentially entangled nonwoven fabric shown in FIG. 3, magnified at 10×, the upper and lower highly entangled surfaces having been pulled away from the lightly entangled central fibrous layer.

FIG. 5 show a cross-section of the same material as depicted in FIG. 3 and FIG. 4, whereby the outer highly entangled layers have been pulled apart from the lightly entangled central core fibers.

Manufacture of a durable nonwoven fabric embodying the principles of the present invention is initiated by providing the precursor nonwoven web preferably in the form of a natural and/or synthetic fibers, most preferably a cotton or cotton blend, which desirably provides good tactile and ductile softness and absorbency. During development, it was ascertained that fabric weights on the order of about 1 to 8 ounces per square yard, with the range of 2 to 5 ounces per square yard being most preferred, provided the best combination of softness, drapeability, absorbency, and durability.

EXAMPLES

Example 1

Using a forming apparatus as illustrated in FIG. 1, a nonwoven fabric was made in accordance with the present invention by providing a fibrous batt comprising 100 weight percent cotton fiber. The fibrous batt had a basis weight of 3.3 ounces per square yard (plus or minus 7%). The fibrous web was 100% carded and cross-lapped, with a draft ratio of 2.5 to 1.

The fabric comprised 100 weight percent cotton as available from Barnhardt Manufacturing Company under code number RMC#2811. The fibrous batt was entangled by a series of entangling manifold stations such as diagrammatically illustrated in FIG. 1 and in greater detail in FIG. 2. FIG. 2 illustrates disposition of fibrous batt P on a foraminous forming surface in the form of belt 02, with the batt acted upon by a pre-entangling manifold 01 operating at 40 bar to form a wetted and lightly entangled fibrous web P'. Pre-entangling of the fibrous web is subsequently effected by movement of the web P' sequentially over a drum 10 having a foraminous forming surface, with entangling manifold 12, operating at 40 bar, effecting entanglement of the web. The web then passes through a series of entangling stations comprising drums having foraminous forming surfaces, for entangling by entangling manifolds, with the web thereafter directed about the foraminous forming surface of a drum 20 for entangling by entanglement manifold 22. The web is thereafter passed over successive foraminous drums 30, 40 and 50, with successive entangling treatment by entangling manifolds 32, 42 and 51. In the present examples, each of the entangling manifolds included 120 micron orifices spaced at 42.3 per inch, with manifolds 22, 32, 42 and 51 successively operated at 0, 50, 0, and 0 bar, with a line speed of 20 meters per minute. The total energy input into the fibrous batt is calculated to be 0.034 hp-hr/lb. A web having a trimmed width of 120 inches was employed.

Comparative Example

The comparative example is selected from a commercially available product in the form of Webril 100% Cotton Undercast Padding as available from the Kendall Company. This product is formed by compression forming cotton fiber during a mercerization process.

The accompanying Table 1 sets forth comparative test data for a fabric made by the present invention compared against a commercially available mercerized cotton fabric. Testing was done in accordance with the following test methods.

| Test | Method |
|---|---|
| Basis weight (ounces/yd$^2$ | ASTM D3776 |
| Bulk (inches) | ASTM D5729 |
| Tensiles MD and CD Grabs (lb/in) | ASTM D5034 |
| Elongation MD and CD Grabs (%) | ASTM D5034 |
| Tensiles MD and CD Strips (lb/in) | ASTM D5035 |
| Elongation MD and CD Strips (%) | ASTM D5035 |
| Absorbent capacity (%) | EDANA 10.3 |
| Airborne particle shedding (Helmke drum) | IEST-RP-CC003.2* |

*IEST-RP: Institute of Environmental Sciences and Technology Recommended Practice. The materials were cut in to samples measuring nominally 6 inches by 9 inches, and the unfinished edges were not sewn under before testing.

TABLE 1

| Physical Property | Units | Example 1 | Comparative Example |
|---|---|---|---|
| Basis Weight | osy | 3.3 | 3.1 |
| Bulk | in | 0.04 | 0.03 |
| Strip Tensile - MD | lb./in. | 1.1 | 1.5 |
| Strip Tensile - CD | lb./in. | 0.7 | 0.2 |
| Combined Strip Tensile/Basis Weight | | 0.5 | 0.5 |
| Strip Elongation - MD | % | 30.0 | 25.0 |
| Strip Elongation - CD | % | 73.8 | 80.6 |
| Combined Strip Elongation/Basis Weight | | 31.1 | 33.7 |
| Grab Tensile - MD | lb./in. | 4.4 | 2.5 |
| Grab Tensile - CD | lb./in. | 3.7 | 0.9 |
| Combined Grab Tensile/Basis Weight | | 2.4 | 1.1 |
| Grab Elongation - MD | % | 45.0 | 34.0 |
| Grab Elongation - CD | % | 43.5 | 108.1 |
| Combined Grab Elongation/Basis Weight | | 26.5 | 42.5 |
| Absorbent capacity | % | 2000 | 1300 |

TABLE 2

| | Particles ($\times 10^3$)/min/m$^2$ | | | | | |
|---|---|---|---|---|---|---|
| Sample | Particles ≧0.5 μm | Particles ≧0.7 μm | Particles ≧1.0 μm | Particles ≧2.0 μm | Particles ≧3.0 μm | Particles ≧5.0 μm |
| Example 1 | 37.9 (3.5)* | 32.5 (2.6) | 26.3 (2.3) | 16.1 (1.6) | 9.9 (1.2) | 5.4 (0.9) |
| Comparative Example | 99.9 (28.8) | 76.1 (22.3) | 52.0 (15.7) | 24.2 (8.1) | 13.2 (4.6) | 6.8 (2.6) |

*Numbers in parentheses represent the standard deviation.

The physical test data for Example 1 and the Comparative Example are given in Table 1. The data in Table 1 show that the nonwoven fabric manufactured by the present invention has more uniform performance versus the comparative example when comparing the machine direction to the cross direction tensile and elongation properties. The materials were also tested for particle shedding. The material manufactured by the present invention exhibited a lower average number of particles shed for each of the particle sizes examined. For particle sizes less than or equal to 1 micron, the material manufactured by the current invention shed 2 to 3 times fewer particles.

From the foregoing, it will be observed that numerous modifications and variations can be affected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

What is claimed:

1. A nonwoven fabric, comprising a single homogeneous fibrous batt formed of fibers selected from the group consisting of: (1) carded cotton fibers; and (2) a carded blend of cotton fibers and synthetic fibers, wherein the single fibrous batt is entangled by the application of hydraulic energy to opposite expansive surfaces of said fibrous batt to form a nonwoven fabric, said nonwoven fabric having highly entangled, opposite outer surface regions and a lightly entangled inner core region positioned between said highly entangled outer surface regions formed by application of hydraulic energy in the range of about 0.027 to 0.046 hp-hr/lb.

2. A nonwoven fabric as in claim 1, wherein the synthetic staple fibers are selected from the group consisting of polyacrylates, polyolefins, polyamides, polyesters and the combinations thereof.

3. A nonwoven fabric as in claim 1, wherein the fabric is imaged by the application of hydraulic energy upon a three-dimensional image transfer device having a movable imaging surface.

4. A nonwoven fabric as in claim 1, wherein the fabric further comprises one or more physical performance enhancing chemistries.

5. A cast padding material, comprising a single homogeneous fibrous batt formed of fibers selected from the group consisting of: (1) carded and cross-lapped cotton fibers; and (2) a carded and cross-lapped blend of cotton fibers and synthetic fibers, wherein the single fibrous batt is entangled by the application of hydraulic energy to opposite expansive surfaces thereof to form a cast padding material, said cast padding material having highly entangled, opposite outer surface regions and a lightly entangled inner core region positioned between said highly entangled outer surface regions formed by application of hydraulic energy in the range of about 0.027 to 0.046 hp-hr/lb.

* * * * *